US010982898B2

(12) United States Patent
Chen et al.

(10) Patent No.: US 10,982,898 B2
(45) Date of Patent: Apr. 20, 2021

(54) MODULARIZED LNG SEPARATION DEVICE AND FLASH GAS HEAT EXCHANGER

(71) Applicant: Air Products and Chemicals, Inc., Allentown, PA (US)

(72) Inventors: Fei Chen, Whitehouse Station, NJ (US); Christopher Michael Ott, Macungie, PA (US); Annemarie Ott Weist, Macungie, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 196 days.

(21) Appl. No.: 15/977,535

(22) Filed: May 11, 2018

(65) Prior Publication Data

US 2019/0346203 A1 Nov. 14, 2019

(51) Int. Cl.
*F25J 3/02* (2006.01)

(52) U.S. Cl.
CPC ..... *F25J 3/0295* (2013.01); *F25J 3/0214* (2013.01); *F25J 2215/04* (2013.01); *F25J 2270/08* (2013.01); *F25J 2290/72* (2013.01)

(58) Field of Classification Search
CPC ..... F25J 1/004; F25J 1/0265; F25J 1/0208; F25J 1/0219; F25J 1/0267; F25J 2200/02; F25J 2200/30; F25J 2200/32; F25J 2200/34; F25J 2200/40; F25J 2205/02; F25J 2205/10; F25J 2205/34; F25J 2270/08; F17C 2227/0372
See application file for complete search history.

(56) References Cited

U.S. PATENT DOCUMENTS 3,274,787 A 9/1966 Grenier et al.
4,026,120 A * 5/1977 Tallant ..... F25B 9/04 62/5

(Continued)

FOREIGN PATENT DOCUMENTS

| | | |
|---|---|---|
| CN | 102596361 | 8/2016 |
| EP | 2857782 | 4/2015 |
| WO | 2010144163 | 12/2010 |

OTHER PUBLICATIONS

G. Venkatarathnam, "Coil wound heat exchangers", Heat Exchanger Design Handbook, 2018 by Begell House, Inc., http://hedhme.com/content_map/?link_id=30125&article_id=15672.

(Continued)

*Primary Examiner* — Frantz F Jules
*Assistant Examiner* — Erik Mendoza-Wilkenfel
(74) *Attorney, Agent, or Firm* — Amy Carr-Trexler

(57) ABSTRACT

Described herein are methods and systems for the liquefaction of natural gas to produce a LNG product. The methods and systems use an apparatus for separating a flash gas from a liquefied natural gas (LNG) stream to produce a LNG product and recovering refrigeration from the flash gas. The apparatus includes a shell casing enclosing a heat exchange zone comprising a coil wound heat exchanger, and a separation zone. The heat exchange zone is located above and in fluid communication with the separation zone. Flash gas is separated from the LNG product in the separation zone and flows upwards from the separation zone into the heat exchange zone where refrigeration is recovered from the separated flash gas.

11 Claims, 10 Drawing Sheets

(56) References Cited

U.S. PATENT DOCUMENTS

| | | | | |
|---|---|---|---|---|
| 4,033,735 | A | 7/1977 | Swenson | |
| 4,330,308 | A | 5/1982 | Grenier et al. | |
| 4,398,397 | A | 8/1983 | Hans | |
| 4,755,194 | A * | 7/1988 | Rooker | B01D 19/0047 95/258 |
| 5,651,270 | A | 7/1997 | Low et al. | |
| 6,389,844 | B1 | 5/2002 | Klein Nagel Voort | |
| 2010/0206542 | A1 | 8/2010 | Johnke et al. | |
| 2010/0287984 | A1 | 11/2010 | Johnke et al. | |
| 2011/0023536 | A1 | 2/2011 | Jager et al. | |
| 2011/0226011 | A1 * | 9/2011 | Johnke | C10G 5/06 62/620 |
| 2016/0313057 | A1 | 10/2016 | Roberts et al. | |

OTHER PUBLICATIONS

Y. Ibrahim, et al, "MLNG Dua Debottlenecking Project", Gas Technology Institute—15th International Conference and Exhibition on Liquified Natural Gas 2007, 2007, 349-358.

A. Francis, "Brazed Aluminum Heat Exchangers (BAHX) Surveillance—Analysis—Mitigation", Proceeding of the 3rd International Gas Processing Symposium, Mar. 5-7, 2012, Qatar.

B. Songhurst, "Floating Liquefaction (FLNG): Potential for Wider Deployment", Oxford Institute for Energy Studies, Nov. 2016.

* cited by examiner

MODULARIZED LNG SEPARATION DEVICE AND FLASH GAS HEAT EXCHANGER

BACKGROUND

The present invention relates generally to methods and systems for the production of a liquefied natural gas (LNG) product. More specifically, the invention relates to an apparatus for separating a flash gas from an LNG stream to produce an LNG product, and for recovering refrigeration from the flash gas. The present invention also relates to methods and systems for producing an LNG product that utilize said apparatus.

The liquefaction of natural gas is an important industrial process. The worldwide production capacity for LNG is more than 300 million tonnes per annum (MTPA). A number of liquefaction systems for cooling, liquefying, and optionally subcooling natural gas are well known in the art.

In a typical liquefaction system, a first natural gas feed stream is pre-cooled, liquefied and optionally subcooled in a main cryogenic heat exchanger (MCHE) via indirect heat exchange with one or more refrigerants, to produce a first LNG stream. The first LNG stream can then be further processed by flashing the first LNG stream to produce a first flashed LNG stream, which is then sent to a vapor-liquid separator (flash drum) to separate the LNG product from the flash gas.

The separated flash gas is removed from the vapor-liquid separator, and warmed in a cold side of a flash gas heat exchanger to produce a warmed flash gas stream, thereby recovering refrigeration from the flash gas and providing cooling duty to the flash gas heat exchanger. The warmed flash gas stream can then be compressed, cooled and recycled back into the natural gas feed stream. A second natural gas feed stream (for example separated from the first natural gas feed stream prior to liquefaction of the latter in the MCHE) can be cooled and liquefied in the flash gas heat exchanger to produce a second LNG stream which can be flashed and combined with the first flashed LNG stream. Alternatively, another type of stream may be passed through and cooled in the warm side of the flash gas heat exchanger, such as a stream of refrigerant circulated by the refrigeration circuit for the MCHE.

A common feature of prior art liquefaction systems is that the vapor-liquid separator and the flash gas heat exchanger are separate units that are connected by piping. For a typical land-based LNG plant that produces around 3 million tonnes of LNG per year, the plot space required for the vapor-liquid separator and flash gas heat exchanger arrangement as described above is approximately 10×20 feet with around 100-300 feet of insulated piping having a diameter of 24" to 30".

A current trend in the LNG industry is to develop remote offshore gas fields, which will require a system for liquefying natural gas to be built on a floating platform, such applications also being known in the art as Floating LNG (FLNG) applications. Designing and operating such a LNG plant on a floating platform poses a number of challenges. One of the main issues is the limited amount of space available on such floating platforms. Typically, the plot space available for FLNG applications is around 60% of a conventional land-based LNG plant.

Another trend in the industry is the development of smaller scale liquefaction facilities, such as in the case of peak shaving facilities, or modularized liquefaction facilities where multiple lower capacity liquefaction trains are used instead of a single high capacity train.

As a result, there is an increasing need in the art for methods and systems for the liquefaction of natural gas that are suitable for use in FLNG applications, peak shaving facilities, and other scenarios where the available footprint is smaller than in conventional land-based LNG facilities.

BRIEF SUMMARY

Disclosed herein are methods and systems for the production of an LNG product. The methods and systems use an apparatus for separating a flash gas from a liquefied natural gas (LNG) stream to produce an LNG product, and for recovering refrigeration from the flash gas. The apparatus includes a shell casing enclosing a heat exchange zone comprising a coil wound heat exchanger, and a separation zone. The heat exchange zone is located above and in fluid communication with the separation zone. Flash gas is separated from the LNG product in the separation zone and flows upwards from the separation zone into the heat exchange zone where refrigeration is recovered from the separated flash gas. The apparatus of the present invention provides for more compact and cost-efficient liquefaction systems and methods that have a smaller footprint than the prior art liquefaction systems and methods for conventional land-based LNG facilities.

Several preferred aspects of the apparatus, system and method according to the present invention are outlined below.

Aspect 1: An apparatus for separating a flash gas from a liquefied natural gas (LNG) stream to produce an LNG product, and for recovering refrigeration from the separated flash gas, the apparatus comprising a shell casing enclosing a heat exchange zone and a separation zone, the heat exchange zone being located above and in fluid communication with the separation zone, the separation zone configured to separate the flash gas from the LNG product and the heat exchange zone being configured to recover refrigeration from the separated flash gas;

wherein the heat exchange zone comprises at least one coil wound tube bundle defining a tube side and a shell side of the heat exchange zone, the tube side defining one or more passages through the heat exchange zone for cooling and/or liquefying a first fluid stream, and the shell side defining a passage through the heat exchange zone for warming separated flash gas;

wherein the separation zone is configured such that flash gas separated from the LNG product in the separation zone flows upwards from the separation zone into and through the shell side of the heat exchange zone;

and wherein the shell casing has:

- a first inlet in fluid flow communication with the tube side of the heat exchange zone for introducing the first fluid stream to be cooled and/or liquefied;
- a first outlet in fluid flow communication with the tube side of the heat exchange zone for withdrawing a first cooled and/or liquefied fluid stream;
- a second outlet in fluid flow communication with the shell side of the heat exchange zone for withdrawing a warmed flash gas stream;
- a second inlet in fluid flow communication with the separation zone for introducing a LNG stream containing flash gas to be separated; and
- a third outlet in fluid flow communication with the separation zone for withdrawing a LNG product stream.

Aspect 2: An apparatus according to aspect 1, further comprising a mist eliminator positioned between the heat exchange zone and the separation zone.

Aspect 3: An apparatus according to aspect 1 or 2, wherein the section of the shell casing enclosing the heat exchange zone and the section of the shell casing enclosing the separation zone have substantially the same diameter.

Aspect 4: An apparatus according to aspect 1 or 2, wherein the section of the shell casing enclosing the separation zone has a larger diameter than the section of the shell casing enclosing the heat exchange zone.

Aspect 5: An apparatus according to any preceding aspect, wherein the separation zone comprises one or more mass transfer devices for bringing downward flowing fluid into contact with upward rising vapor and wherein the second inlet is positioned above one or more of the mass transfer devices.

Aspect 6: An apparatus according to any preceding aspect, wherein the apparatus further comprises a reboiler heat exchanger for re-boiling a portion of the LNG from a bottom end of the separation zone so as to generate upward flowing vapor through the separation zone.

Aspect 7: An apparatus according to any one of aspects 1 to 4 wherein the separation zone is an empty section of the shell casing defining a sump zone for collection of LNG and a head space zone above the sump zone and below the heat exchange zone for collection of flash gas.

Aspect 8: An apparatus according to any preceding aspect, wherein the heat exchange zone comprises a first coil wound tube bundle located above a second coil wound tube bundle, the bundles defining a tube side and shell side of the heat exchange zone, the tube side defining one or more passages through the heat exchange zone for cooling and/or liquefying a first fluid stream, and the shell side defining a passage through the heat exchange zone for warming separated flash gas;

wherein the tube side defined by the first tube bundle is in fluid flow communication with the first inlet and defines at least one passage for cooling and/or liquefying the first fluid stream;

wherein the shell casing has a fourth outlet in fluid flow communication with the tube side of the first tube bundle for withdrawing a cooled and/or liquefied portion of the first fluid stream from the first tube bundle; and wherein the tube side defined by the second tube bundle is in fluid flow communication with the tube side of the first tube bundle and with the first outlet, and defines at least one passage for further cooling and/or liquefying another portion of the first fluid stream from the first tube bundle.

Aspect 9: An apparatus according to any one of aspects 1 to 7, wherein the shell casing has a fourth outlet in fluid flow communication with the shell side of the heat exchange zone, and located below the second outlet, for withdrawing a partially warmed flash gas stream at a lower temperature than the warmed flash gas stream withdrawn from the second outlet.

Aspect 10: A system for producing a liquefied natural gas (LNG) product, the system comprising:

a main cryogenic heat exchanger (MCHE) for cooling and liquefying a natural gas feed stream so as to produce an LNG stream;

a refrigeration circuit in fluid flow communication with the MCHE for circulating a main refrigerant and passing one or more cold streams of the refrigerant through the MCHE so as to provide cooling duty for liquefying the natural gas stream, the one or more cold streams of refrigerant being warmed in the MCHE via indirect heat exchange with the natural gas stream;

a first pressure reduction device in fluid flow communication with the MCHE for reducing the pressure of all or a portion of the LNG stream to form a reduced pressure LNG stream;

an apparatus according to any one of aspects 1 to 9, in fluid flow communication with the first pressure reduction device, for separating flash gas from the reduced pressure LNG stream and recovering refrigeration from the separated flash gas to produce a LNG product stream and a warmed flash gas stream.

Aspect 11: A system according to aspect 10, wherein the first fluid stream is an auxiliary natural gas feed stream to be cooled and liquefied in the heat exchange zone to produce an auxiliary LNG stream, the system is configured to reduce the pressure of the auxiliary LNG stream, and the apparatus according to any one of aspects 1 to 9 is configured to also receive the reduced pressure auxiliary LNG stream, separate flash gas from the reduced pressure auxiliary LNG stream, and recover refrigeration from said separated flash gas.

Aspect 12: A system according to aspect 10, wherein the refrigeration circuit is in fluid flow communication with the apparatus according to any one of aspects 1 to 9, the first fluid stream is a stream of refrigerant to be cooled and/or liquefied in the heat exchange zone to provide a stream of cooled and/or liquefied refrigerant, and the refrigeration circuit is configured to introduce the stream of refrigerant into the first inlet of the apparatus, to withdraw the stream of cooled and/or liquefied refrigerant from the first outlet of the apparatus, and to pass the stream of cooled and/or liquefied refrigerant through the MCHE.

Aspect 13: A method of producing a liquefied natural gas (LNG) product the method employing the system of aspect 10, the method comprising:

(a) passing a natural gas feed stream through and cooling and liquefying the natural gas feed stream in the MCHE to produce a LNG stream;

(b) withdrawing the LNG stream from the MCHE and reducing the pressure of all or a portion of the LNG stream to form a reduced pressure LNG stream;

(c) introducing the reduced pressure LNG stream into the separation zone of the apparatus and separating flash gas from the reduced pressure LNG stream to produce an LNG product stream; and (d) recovering refrigeration from the separated flash gas in the heat exchange zone of the apparatus to produce a warmed flash gas stream.

Aspect 14: A method according to aspect 13, wherein the first fluid stream is an auxiliary natural gas feed stream, and wherein step (d) comprises cooling and liquefying the auxiliary natural gas feed stream in the heat exchange zone to produce an auxiliary LNG stream, the method further comprising reducing the pressure of the auxiliary LNG stream, introducing the reduced pressure auxiliary LNG stream into the separation zone of the apparatus to separate flash gas from the reduced pressure auxiliary LNG stream, and recovering refrigeration from the separated flash gas.

Aspect 15: A method according to aspect 13, wherein the first fluid stream is a stream of refrigerant, and wherein step (d) comprises cooling and/or liquefying the stream of refrigerant in the heat exchange zone of the apparatus to provide a stream of cooled and/or liquefied refrigerant, the method further comprising withdrawing the stream of cooled and/or liquefied refrigerant from the apparatus, and passing the stream of cooled and/or liquefied refrigerant through the MCHE.

DETAILED DESCRIPTION

Figure 1:
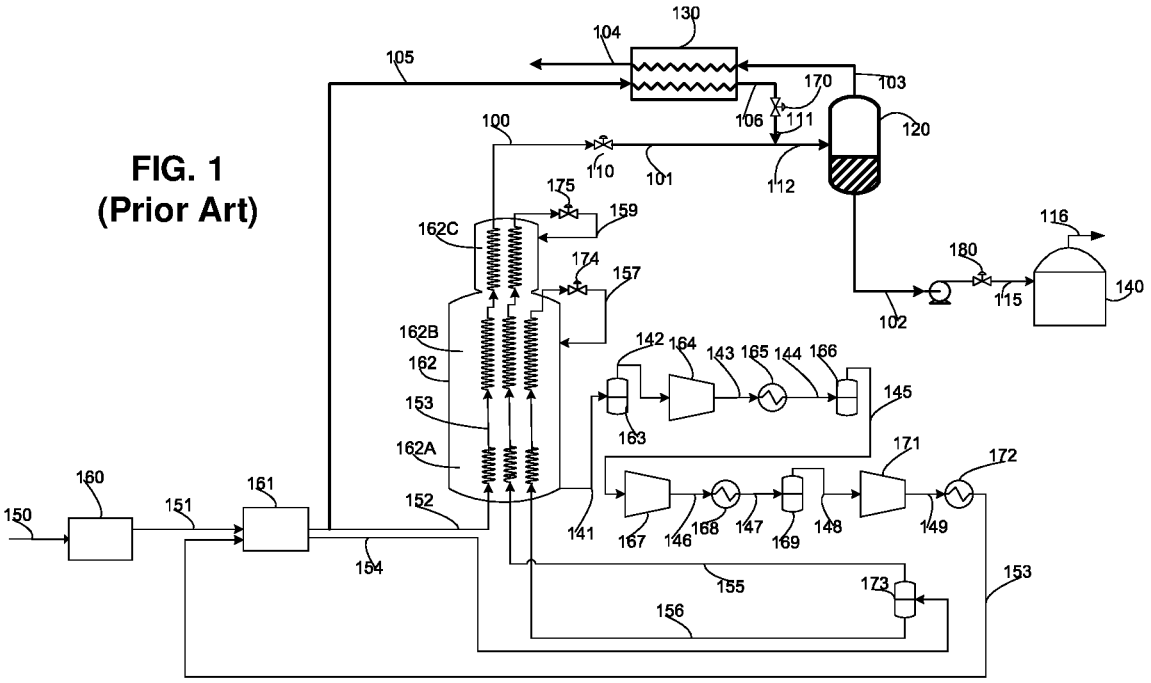
FIG. 1 (Prior Art)
FIG. 1 is a schematic flow diagram depicting a natural gas liquefaction method and system in accordance with the prior art.

Described herein is an apparatus for separating a flash gas from a liquefied natural gas (LNG) stream to produce an LNG product, and for recovering refrigeration from the flash gas, and methods and systems for the production of an LNG product that utilize said apparatus. The apparatus, methods and systems of the present invention are particularly suitable and attractive for Floating LNG (FLNG) applications, peak shaving applications, modular liquefaction facilities, small scale facilities, and/or any other applications in which the available footprint for the plant places restrictions on the size of the liquefaction system.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Where used herein to identify recited features of a method or system, the terms "first", "second", "third" and so on, are used solely to aid in referring to and distinguishing between the features in question, and are not intended to indicate any specific order of the features, unless only to the extent that such order is specifically recited.

Reference numerals that are introduced in the specification in association with a drawing figure may be repeated in one or more subsequent figures without additional description in the specification in order to provide context for other features. In the figures, elements that are similar to those of other embodiments are represented by reference numerals increased by a value of 100. For example, the vapor-liquid separator 120 associated with the embodiment of FIG. 1 corresponds to the vapor-liquid separator 220 associated with the embodiment of FIG. 2. Such elements should be regarded as having the same function and features unless otherwise stated or depicted herein, and the discussion of such elements may therefore not be repeated for multiple embodiments.

As used herein, the terms "natural gas" and "natural gas stream" encompass also gases and streams comprising synthetic and/or substitute natural gases. The major component of natural gas is methane (which typically comprises at least 85 mole %, more often at least 90 mole %, and on average about 95 mole % of the feed stream). Natural gas may also contain smaller amounts of other, heavier hydrocarbons, such as ethane, propane, butanes, pentanes, etc. Other typical components of raw natural gas include one or more components such as nitrogen, helium, hydrogen, carbon dioxide and/or other acid gases, and mercury. However, the natural gas feed stream processed in accordance with the present invention will have been pre-treated if and as necessary to reduce the levels of any (relatively) high freezing point components, such as moisture, acid gases, mercury and/or heavier hydrocarbons, down to such levels as are necessary to avoid freezing or other operational problems in the heat exchanger section or sections in which the natural gas is to be liquefied and/or subcooled.

As used herein, the term "refrigeration cycle" refers the series of steps that a circulating refrigerant undergoes in order to provide refrigeration to another fluid, and the term "refrigeration circuit" refers to the series of connected devices in which the refrigerant circulates and that carry out the aforementioned steps of the refrigeration cycle. Typically, a refrigeration cycle will comprise compressing one or more streams of warm refrigerant to form a compressed refrigerant, cooling the compressed refrigerant, expanding the cooled compressed refrigerant to form one or more streams of expanded cold refrigerant in one or more heat exchanger sections to provide the desired refrigeration. The compression can be carried out in one or more compressors/compression stages. The cooling can be carried out in one or more intercoolers and/or aftercoolers and/or in one or more heat exchanger sections in which the expanded cold refrigerant is warmed. The expansion can be carried out in any suitable form of pressure reduction device, such as one or more turbo-expanders and/or J-T valves.

As used herein, the term "mixed refrigerant" refers, unless otherwise indicated, to a composition comprising methane and one or more heavier and/or lighter components. The term "heavier component" refers to components of the mixed refrigerant that have a lower volatility (i.e. higher boiling point) than methane. The term "lighter component" refers to components having the same or a higher volatility (i.e. the same or a lower boiling point) than methane. Typical heavier components include heavier hydrocarbons, such as but not limited to ethane/ethylene, propane, butanes and pentanes. Additional or alternative heavier components may include hydrofluorocarbons (HFCs). Nitrogen is often also present in the mixed refrigerant, and constitutes an exemplary additional light component.

As used herein, the term "heat exchanger section" refers to a unit or a part of a unit in which indirect heat exchange is taking place between one or more streams of colder fluid (such as refrigerant) and one or more other streams of warmer fluid, such that the stream(s) of colder fluid are warmed and the stream(s) or warmer fluid are cooled as each pass through the heat exchanger section.

As used herein, the term "main cryogenic heat exchanger" refers to a heat exchanger unit comprising one or more heat exchanger sections in which a main natural gas feed stream is liquefied.

As used herein, the term "heat exchange zone" refers to a zone in which indirect heat exchange is taking place between two or more streams of fluid.

As used herein, the term "separation zone" refers to a zone in which separation of a vapor-liquid mixture is taking place. The separation zone can be an empty bottom section of the shell casing of the apparatus defining a sump zone at the bottom of the shell casing for collection of LNG and a head space zone above the sump zone and below the heat exchange zone for collection of flash gas. Alternatively, the separation zone can comprise one or more mass transfer devices for bringing downward flowing fluid into contact with upward rising vapor. The one of more mass transfer devices can be any suitable device known in the art, such as, for example, random packing, structured packing, and/or one or more plates or trays.

As used herein, the term "indirect heat exchange" refers to heat exchange between two fluids where the two fluids are kept separate from each other by some form of physical barrier.

The term "fluid flow communication," as used herein, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

As used herein, the term "coil wound heat exchanger" refers to a heat exchanger of the type known in the art, comprising one or more coil wound tube bundles encased in a shell casing, wherein each tube bundle may have its own shell casing, or wherein two or more tube bundles may share a common shell casing. Each tube bundle may represent a "coil wound heat exchanger section", the tube side of the bundle typically representing the warm side of said section and defining one or more than one passage through the section, and the shell side of the bundle typically representing the cold side of said section defining a single passage through the section.

The terms "bundle", "tube bundle" and "coil wound tube bundle" are used interchangeably within this application and are intended to be synonymous.

As used herein, the term "warm side" as used to refer to part of a heat exchanger section refers to the side of the heat exchanger through which one or more streams of fluid pass that are to be cooled by indirect heat exchange with the fluid flowing through the cold side of the heat exchanger section. The warm side may define a single passage through the heat exchanger section for receiving a single stream of fluid, or more than one passage through the heat exchanger section for receiving multiple streams of the same or different fluids that are kept separate from each other as they pass through the heat exchanger section.

As used herein, the term "cold side" as used to refer to part of a heat exchanger section refers to the side of the heat exchanger through which one or more streams of fluid pass that are to be warmed by indirect heat exchange with the fluid flowing through the warm side of the heat exchanger section. The cold side may comprise a single passage for receiving a single stream of fluid, or more than one passage for receiving multiple streams of fluid that are kept separate from each other as they pass through the heat exchanger section.

As used herein, the term "flashing" (also referred to in the art as "flash evaporating") refers to the process of reducing the pressure of a liquid or two-phase (i.e. gas-liquid) stream so as to partially vaporize the stream, thereby generating a "flashed" stream that is a two-phase stream that is reduced in pressure and temperature. The vapor (i.e. gas) present in the flashed stream is referred to herein as the "flash gas". A liquid or two-phase stream may flashed by passing the stream through any pressure reducing device suitable for reducing the pressure of and thereby partially vaporizing the stream, such for example a J-T valve or a hydraulic turbine (or other work expansion device).

As used herein, the term "J-T" valve or "Joule-Thomson valve" refers to a valve in and through which a fluid is throttled, thereby lowering the pressure and temperature of the fluid via Joule-Thomson expansion.

As used herein, the term "vapor-liquid separator" refers to vessel, such as but not limited to a flash drum or knock-out drum, into which a two phase stream can be introduced in order to separate the stream into its constituent vapor and liquid phases, whereby the vapor phase collects at and can be withdrawn from the top of the vessel and the liquid phase collects at and can be withdrawn from the bottom of the vessel. The vapor that collects at the top of the vessel is also referred to herein as the "overheads" or "vapor overhead", and the liquid that collects at the bottom of the vessel is also referred to herein as the "bottoms" or "bottom liquid". Where a J-T valve is being used to flash a liquid or two-phase stream, and a vapor-liquid separator (e.g. flash drum) is being used to separate the resulting flash gas and liquid, the valve and separator can be combined into a single device, such as for example where the valve is located at the inlet to the separator through which the liquid or two-phase stream is introduced.

As used herein, the term "mist eliminator" refers to a device for removing entrained droplets or mist from a vapor stream. The mist eliminator can be any suitable device known in the art, including but not limited to a mesh pad eliminator or a vane type mist eliminator.

Referring now to FIG. 1, a natural gas liquefaction method and system in accordance with the prior art is shown. A raw natural gas feed stream 150 is optionally pretreated in a pretreatment system 160 to remove impurities such as mercury, water, acid gases, and heavy hydrocarbons and produce a pretreated natural gas feed stream 151, which may be optionally be precooled in a precooling system 161 to produce a natural gas feed stream 152 (also referred to herein as the main natural gas feed stream).

The natural gas feed stream 152 is then precooled, liquefied and subcooled in the warm side of the main cryogenic heat exchanger (MCHE) 162 to produce a first LNG stream 100. The MCHE 162 may be a coil wound heat exchanger as shown in FIG. 1, or it may be another type of heat exchanger such as plate and fin, or shell and tube heat exchanger, or any other suitable type of heat exchanger known in the art. It may also consist of one or multiple sections. These sections be of the same or different types, and may be contained in separate casings or a single casing. Where the MCHE 162 is a coil wound heat exchanger, the sections may be tube bundles of the heat exchanger.

The MCHE 162 shown in FIG. 1 has three heat exchanger sections, namely a first heat exchanger section 162A located at the warm end of the MCHE 162 (and also referred to herein as the warm section), wherein the natural gas feed stream 152 is pre-cooled to produce a pre-cooled natural gas stream 153, a second heat exchanger section 162B located in the middle of the MCHE 162 (and also referred to herein as the middle section) in which the precooled natural gas stream 153 from the first section 162A is further cooled and liquefied, and a third heat exchanger section 162C at the cold end of the MCHE 162 (also referred to herein as the cold section) in which the LNG stream from the second section 162B is subcooled to produce a subcooled LNG stream 100. The subcooled LNG stream 100 exiting the cold section 162C of MCHE 162 is then flashed by passing the stream through a first pressure reduction device 110 (e.g. a J-T valve) to produce a reduced pressure LNG stream 101 (also referred to herein as the flashed LNG stream or flashed main LNG stream).

The natural gas feed stream 152 is precooled, liquefied and subcooled in the MCHE 162 by indirect heat exchange with cold vaporized or vaporizing mixed refrigerant flowing through the cold side of the MCHE.

Refrigeration for the MCHE 162 is provided by a refrigerant circulating in a refrigeration circuit comprising the sections 162A-C of the MCHE 162; a compressor train comprising compressors/compression stages 164, 167 and 171, intercoolers 165 and 168 and aftercooler 172; phase separator 173; and J-T valves 174 and 175. The refrigerant is typically a mixed refrigerant (MR) comprising a mixture of hydrocarbons (predominantly methane) and nitrogen, as is well known in the art.

Referring to FIG. 1, a warm gaseous mixed refrigerant stream 141 is withdrawn from the MCHE 162 and any liquid present in it during transient off-design operations, may be removed in a first knock out drum 163. The overhead warm gaseous refrigerant stream 142 is then compressed in the first compressor 164 to produce a first compressed refrigerant stream 143, cooled against ambient air or cooling water in the first intercooler 165 to produce a first cooled compressed refrigerant stream 144. Any liquid present in the first cooled compressed refrigerant stream 144 during transient off-design operations is removed in a second knock out drum 166. The overhead first cooled compressed refrigerant stream 145 is further compressed in the second compressor 167 to produce a second compressed refrigerant stream 146, and cooled against ambient air or cooling water in the second intercooler 168 to produce a second cooled compressed refrigerant stream 147. Any liquid present in the second cooled compressed refrigerant stream 147 during transient off-design operations is removed in a third knock out drum 169. The overhead second cooled compressed refrigerant stream 148 is further compressed in the third compressor 171 to produce a third compressed mixed refrigerant stream 149, and cooled against ambient air or cooling water in the aftercooler 172 to produce a third cooled compressed refrigerant stream 153.

The third cooled compressed refrigerant stream 153 is introduced into precooling system 161 where is it cooled to produce a two-phase refrigerant stream 154. The precooling system can use any suitable refrigerant circuit/cycle known in the art, such as, for example a propane refrigeration cycle. The two-phase refrigerant stream 154 is introduced into the phase separator 173 where it separated into mixed refrigerant vapor (MRV) stream 155 and a mixed refrigerant liquid (MRL) stream 156.

The MRL stream 156 is passed through the warm side of the warm section 162A and middle section 162B of the MCHE 162, via a separate passage in said warm side to the passage through which the natural gas feed stream 152 is passed, so as to be cooled therein, and is then expanded through J-T valve 174 to form a stream of cold refrigerant 157 that is introduced into the cold side of the MCHE 162, to provide cold vaporized or vaporizing mixed refrigerant flowing through the cold side of the middle and warm sections 162B and 162A.

The MRV stream 155 is passed through the warm side of the warm section 162A, middle section 162B and cold section 162C of the MCHE 162, via a separate passage in said warm side to the passage through which the natural gas feed stream 152 is passed, and the passage through which the MLR stream 156 is passed, so as to be cooled and at least partially liquefied, and is then expanded through an expansion device 175 to form a stream of cold refrigerant 159 that is introduced into the cold side of the MCHE 162, to provide cold vaporized or vaporizing mixed refrigerant flowing through the cold side of the cold, middle, and warm sections 162C, 162B and 162C.

An auxiliary natural gas feed stream 105 that is divided from the natural gas feed stream 152 prior to the latter being liquefied in the MCHE 162, is cooled and liquefied in a flash gas heat exchanger 130 to produce an auxiliary LNG stream 106, which is flashed by passing the stream through a second pressure reduction device 170 to produce a flashed auxiliary LNG feed stream 111, which is then mixed with the flashed main LNG stream 101 to produce a mixed LNG stream 112.

The mixed LNG stream 112 is sent to vapor-liquid separator 120 where it is separated into flash gas and LNG product. The separated flash gas is removed from the vapor-liquid separator 120 as flash gas stream 103 and introduced into the flash gas heat exchanger 130 where it is warmed to produce a warmed flash gas stream 104, thereby providing cooling duty to the flash gas heat exchanger 130. The warmed flash gas stream 104 exiting the flash gas heat exchanger 130 may be compressed and cooled to a produce a compressed flash gas stream that is recycled back into the natural gas feed stream 152 (not shown). By cooling and liquefying an auxiliary natural gas feed stream 105 in the flash gas heat exchanger 130 via indirect heat exchange with the flash gas stream 103, refrigeration can be recovered from the flash gas stream 103.

The bottoms stream from the vapor-liquid separator 120 is removed as a LNG product stream 102, which may (as depicted) be letdown in pressure in a third pressure reduction device 180 to produce a reduced pressure LNG product stream 115, which is sent to the LNG storage tank 140. Any boil off gas (or further flash gas) produced or present in the LNG storage tank is removed from the tank as boil off gas (BOG) stream 116, which may be used as fuel in the plant or flared, or mixed with the flash gas stream 103 and subsequently recycled to the feed (not shown).

Figure 2:
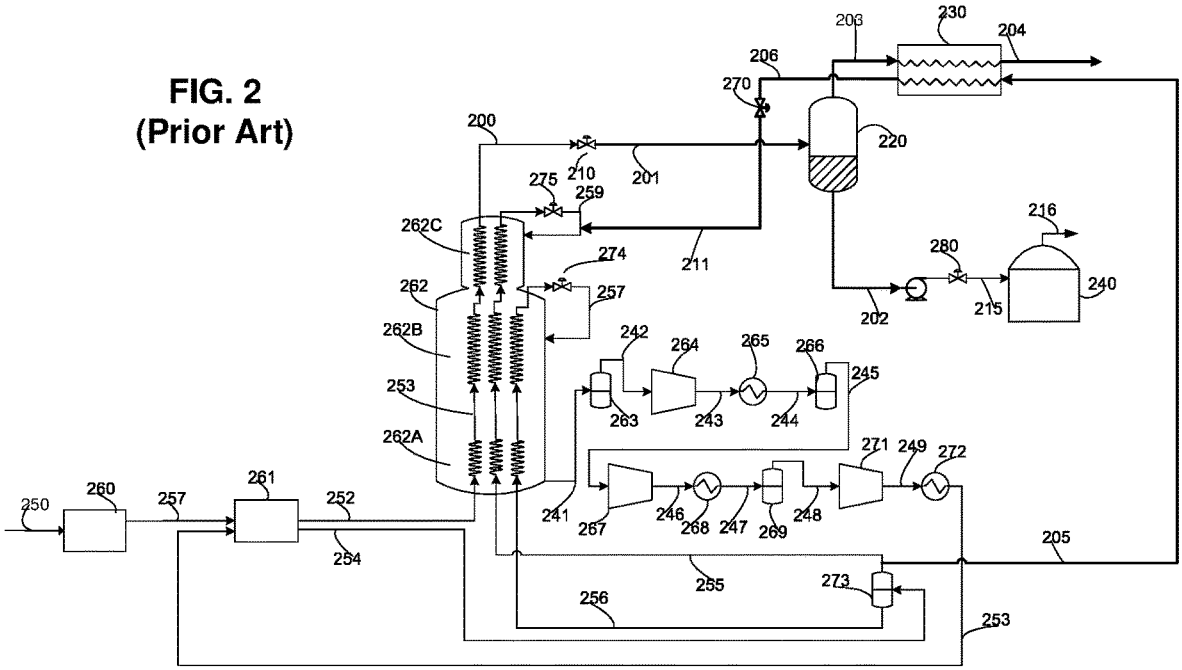
FIG. 2 (Prior Art)
FIG. 2 is a schematic flow diagram depicting a natural gas liquefaction method and system in accordance with the prior art.

FIG. 2 shows an alternative prior art arrangement to that shown in FIG. 1. In FIG. 2, instead of cooling and liquefying an auxiliary natural gas feed stream, flash gas heat exchanger 230 is used to cool a stream of refrigerant that is then expanded and introduced into the cold side of the MCHE 262. In the depicted embodiment, the MRV stream is split into two portions. The first, main portion is passed as stream 252 through the warm side of the MCHE 262 as previously described, and then expanded through expansion device 275 to form the stream of cold refrigerant 259 that is then introduced into the cold side of the MCHE 262 to provide cold vaporized or vaporizing refrigerant flowing through the cold side of the MCHE 262. A second, minor portion of the MRV stream is passed as stream 205 through and is cooled and at least partially liquefied in flash gas heat exchanger 230 to form a cooled refrigerant stream 206. Cooled refrigerant stream 206 is then passed through an expansion device 270 to produce a stream of cold refrigerant 211, which is combined with stream 259 prior to the introduction thereof into the cold side of the MCHE 262.

Figure 3:
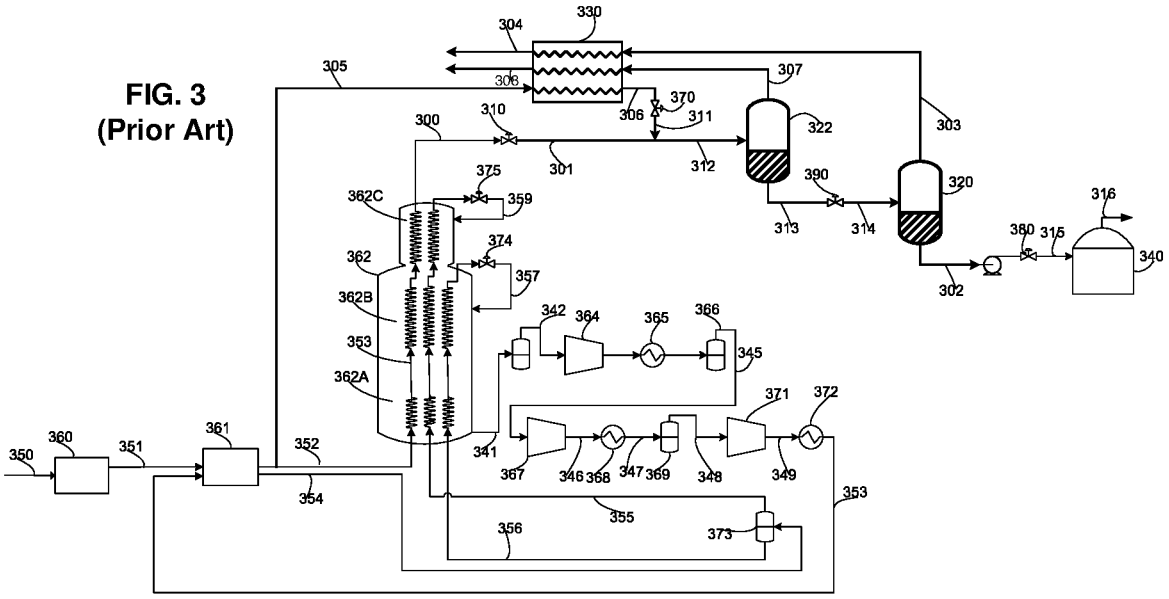
FIG. 3 (Prior Art)
FIG. 3 is a schematic flow diagram depicting a natural gas liquefaction method and system in accordance with the prior art.

FIG. 3 shows a further alternative prior art arrangement to that shown in FIG. 1. In the arrangement shown in FIG. 3, the pressure reduction of the LNG product stream (corresponding to 102 in FIG. 1) is a two-step process and is useful for recovering a stream concentrated in helium. In this case, the LNG stream 300 exiting the MCHE 362 is reduced in pressure by a first pressure reduction device 310 to an intermediate pressure of around 2-7 bara, forming a flashed LNG stream 301.

An auxiliary natural gas feed stream 305 is cooled and liquefied in flash gas heat exchanger 330 to produce an auxiliary LNG stream 306, which is reduced in pressure by passing the stream through a second pressure reduction device 370 to produce a flashed auxiliary LNG stream 311 at the same pressure as the flashed main LNG stream 301 and that it mixed with the flashed main LNG stream to produce a mixed LNG stream 312.

Mixed LNG stream 312 is then introduced into vapor-liquid separator 322, which separates mixed LNG stream 312 into an LNG stream 313 that is sent to low pressure vapor-liquid separator 320, and a cold flash gas stream 307 that is concentrated in helium. The intermediate pressure to which the main and auxiliary LNG streams are reduced is chosen such that only a small amount of vapor results (typically less than 1% molar of the mixed LNG stream 312) so that helium is concentrated in the flash gas stream 307. LNG stream 313 is reduced in pressure by passing the stream through a third pressure reduction device 390 to an intermediate pressure of around 1 bara, forming flashed LNG stream 314. Flashed LNG stream 314 is then introduced into low pressure vapor-liquid separator 320, which separates the stream into an LNG product stream 302 and a cold flash gas stream 303. LNG product stream 302 may (as depicted) be letdown in pressure in a fourth pressure reduction device 380 to produce a reduced pressure LNG product stream 315, which is sent to the LNG storage tank 340. Any boil off gas (or further flash gas) produced or present in the LNG storage tank is removed from the tank as boil off gas (BOG) stream 316, which may be used as fuel in the plant or flared, or mixed with the flash gas stream 303 and subsequently recycled to the feed (not shown).

Flash gas streams 307 and 303 are then warmed in separate passages in the cold side of the flash gas heat exchanger 330. By cooling and liquefying an auxiliary natural gas feed stream 305 in flash gas heat exchanger 330 via indirect heat exchange with the flash gas streams, refrigeration can be recovered from the flash gas streams 307 and 303.

Figure 9:
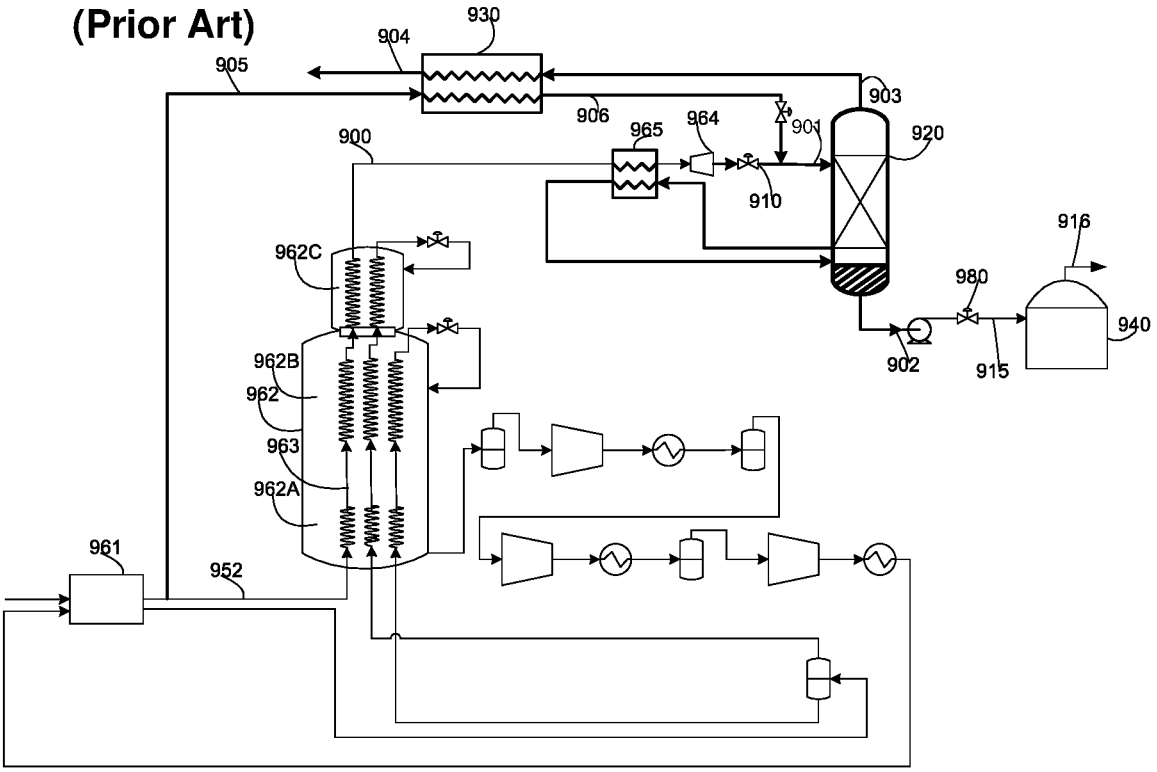
FIG. 9 (Prior Art)
FIG. 9 is a schematic flow diagram depicting a natural gas liquefaction method and system in accordance with the prior art.

FIG. 9 shows a prior art arrangement that is used to liquefy natural gas containing nitrogen. A typical specification for commercial LNG is a nitrogen content of less than 1% molar, however many natural gas feeds have a higher a nitrogen content. The system of FIG. 9 employs a separator in the form of a stripping column 920 to reduce the nitrogen content of the LNG product. A main LNG stream 900 from the MCHE 962 is further cooled in reboiler 965 providing re-boiling duty to the bottom of stripping column 920. The LNG stream is then expanded through an optional hydraulic turbine 964, followed by a first pressure reduction device (e.g. J-T valve) 910 to produce a reduced pressure LNG stream 901 that is then introduced into the top of stripping column 920 at a pressure of around 1 bara. Inside the column there are distillation trays or packing so that the LNG flowing down the column is depleted in nitrogen by the rising vapor generated by reboiler 965. The flash gas stream 903 leaving the top of stripping column 920 is enriched in nitrogen and represents about 5-20% of the total LNG feed flow into the column. Flash gas stream 903 is then warmed in flash gas heat exchanger 930 against a fluid stream such as an auxiliary natural gas stream 905, similar to FIG. 1 (as depicted) or, alternatively, a refrigerant stream, similar to FIG. 2 (not shown).

A drawback of the prior art arrangements shown in FIGS. 1, 2, 3 and 9 is that the vapor-liquid separator 120/220/320/920 and flash gas heat exchanger 130/230/330/930 are separate vessels connected by piping. The use of separate vessels requires a large plot area, which is undesirable for FLNG applications where plot area is limited. In addition, the pressure drop that occurs in line 103/203/303/903 significantly increases the power required to compress stream 104/204/304/904 in order to use it as plant fuel or to recycle it to the natural gas feed stream.

Figure 10:
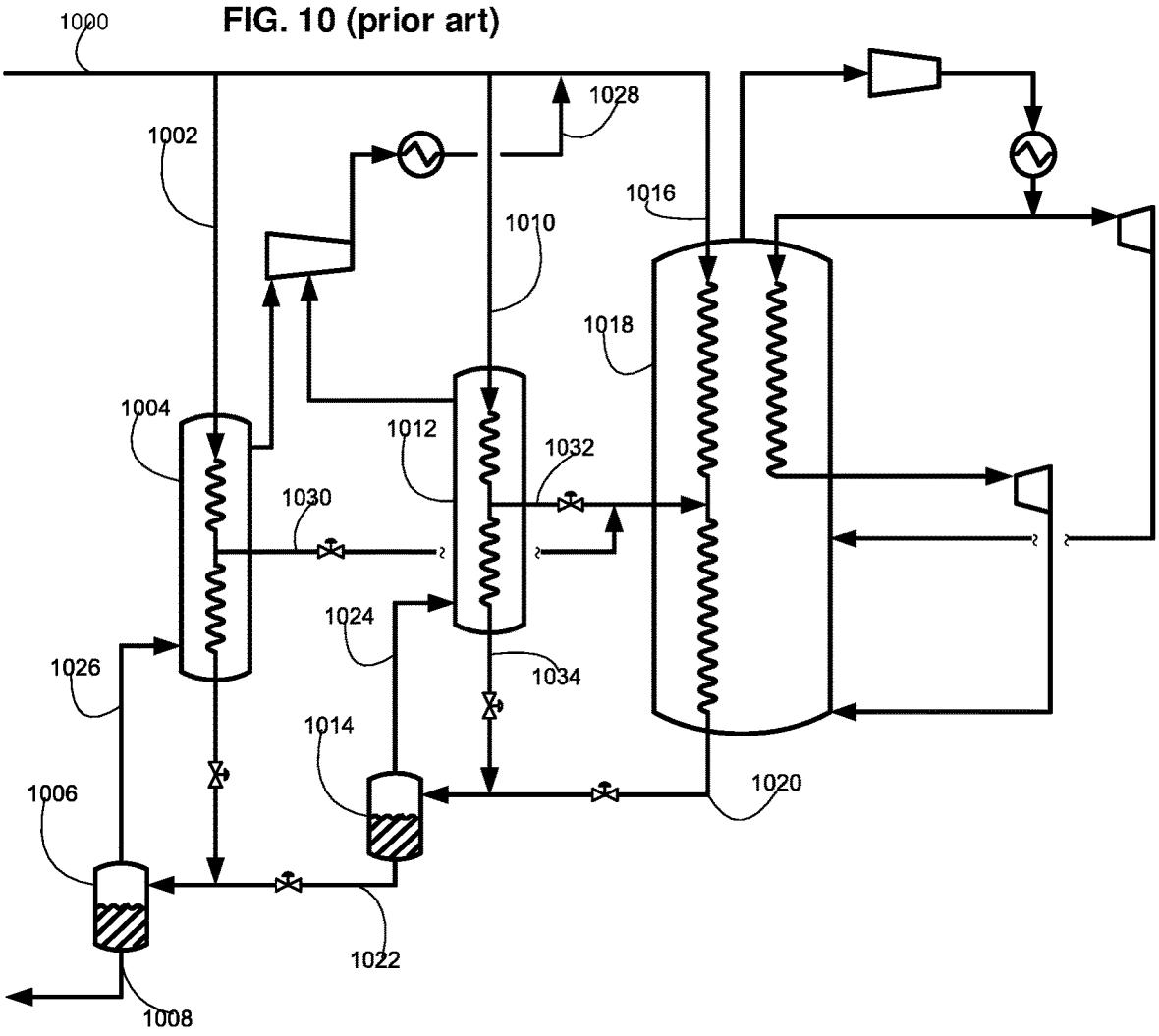
FIG. 10 (prior art)
FIG. 10 is a schematic flow diagram depicting a natural gas liquefaction method and system in accordance with the prior art.

FIG. 10 shows a further prior art arrangement. In this arrangement, natural gas is liquefied using a gas expander refrigeration (or Brayton) cycle, and further cooled in a series of flash steps. Feed gas stream 1000 is split into three natural gas streams 1002, 1010 and 1016. The largest stream, main natural gas stream 1016 which represents about ⅔ of the total feed, is mixed with recycled flash gas 1028 and then sent to the MCHE 1018 where it is liquefied by indirect heat exchange with a gaseous refrigerant to produce a main LNG stream 1020. The main LNG stream 1020 is then let down in pressure in a pressure reduction device to about 8 bara and sent to vapor-liquid separator 1014 where it is separated into flash gas stream 1024 and LNG stream 1022. The LNG stream 1022 from the vapor-liquid separator is then let down in pressure in another pressure reduction device to around 1 bara and then sent to vapor-liquid separator 1006 forming the product LNG stream 1008 and another flash gas stream 1026. The resulting flash gas streams 1024 and 1026 are warmed in flash gas heat exchangers 1012 and 1004 respectively while cooling and liquefying auxiliary natural gas streams 1002 and 1010. The warmed flash gas streams are then compressed to the feed pressure and cooled in an aftercooler to form the recycled flash gas stream 1028.

Flash gas heat exchangers 1004 and 1012 each comprise a warm section (e.g. a warm tube bundle where the heat exchangers are coil wound heat exchangers) and a cold section (e.g. a cold tube bundle). Auxiliary natural gas streams 1002 and 1010 are cooled in the warm sections of the flash gas heat exchangers 1004 and 1012 respectively. After cooling, a small portion (around 20%) of each stream (1030 and 1032) is withdrawn from each flash gas heat exchanger and combined with the main natural gas stream in the MCHE. By removing these streams the cooling curves of the flash heat exchangers are improved. The remaining portions of the auxiliary natural gas streams are further cooled and liquefied in the cold section of flash gas heat exchangers 1004 and 1012, reduced in pressure in pressure reduction devices, and then introduced into vapor-liquid separators 1006 and 1004 respectively.

Figure 4:
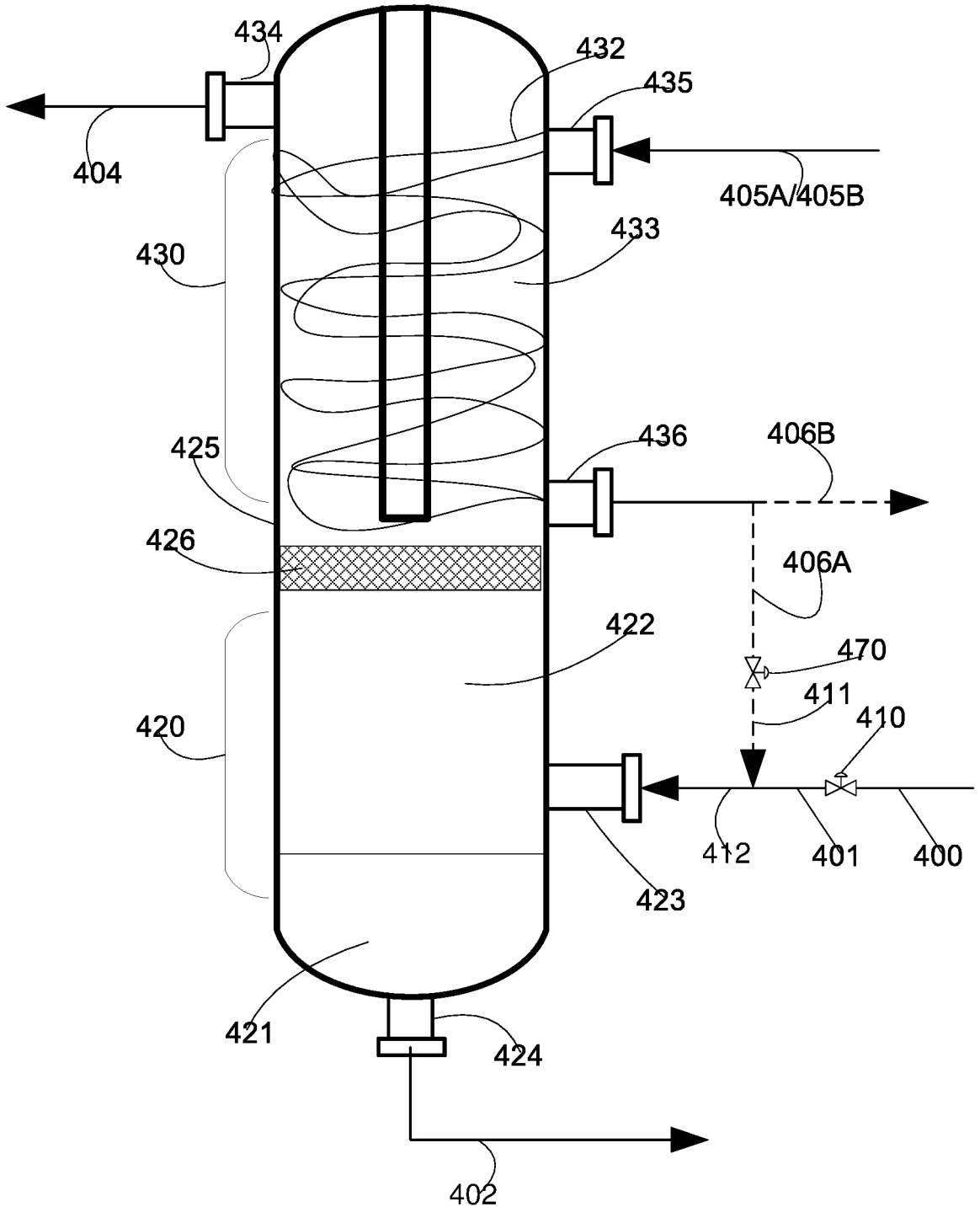
FIG. 4 is a schematic flow diagram depicting an apparatus for separating a flash gas from a liquefied natural gas (LNG) stream in accordance with a first embodiment.

FIG. 4 shows a first exemplary embodiment of an apparatus according to the present invention that can, for example, be used in the prior art arrangements of FIG. 1 or FIG. 2 in place of vapor-liquid separator 120/220; flash gas heat exchanger 130/230, and associated piping. The apparatus comprises a shell casing 425 enclosing a heat exchange zone 430 and a separation zone 420. The present invention therefore advantageously combines the functions of the vapor-liquid separator drum 120/220 and flash gas heat exchanger 130/230 of FIG. 1/FIG. 2 into a single compact vessel, whilst eliminating line 103/203 and its associated pressure drop.

The heat exchange zone 430 is located above and in fluid communication with the separation zone 420. The section of the shell casing 425 enclosing the heat exchange zone 430 and the section of the shell casing 425 enclosing the separation zone 420 have substantially the same diameter. The separation zone 420 is configured to separate flash gas from LNG product and the heat exchange zone 430 is configured to recover refrigeration from the separated flash gas. In the embodiment shown in FIG. 4, the separation zone 420 is an empty bottom section of the shell casing 425 and defines a sump zone 421 for collection of LNG and a head space zone 422 above the sump zone 421 and below the heat exchange zone 430 for collection of flash gas. The heat exchange zone 430 comprises at least one coil wound tube bundle defining a tube side 432 inside the tubes of the tube bundle, and shell side 433 between the outer surface of the tubes of the tube bundle and the internal wall of shell casing 425.

An LNG stream 400 exiting the MCHE (not shown), such as for example LNG stream 100 or 200 of FIG. 1/FIG. 2, is reduced in pressure in a first pressure reduction device 410 (e.g. a J-T valve) to produce a reduced pressure LNG stream 401 (also referred to herein as the flashed main LNG stream).

In one embodiment of FIG. 4, an auxiliary natural gas feed stream 405A (such as for example stream 105 of FIG. 1) is introduced into heat exchange zone 430 via a first inlet 435 at the top of the heat exchange zone 430, where it is cooled and liquefied in the tube side 432 of the heat exchange zone 430 to produce an auxiliary LNG stream 406A which is removed from the heat exchange zone 430 via a first outlet 436, located at the bottom of the heat exchange zone 430. The auxiliary LNG stream 406A is reduced in pressure in a second pressure reduction device 470 to produce a flashed auxiliary LNG stream 411, which is mixed with the flashed main LNG stream 401 to produce a mixed LNG stream 412. Alternatively, the auxiliary LNG stream 406A could be combined with the main LNG stream 400, to form a combined stream that is then flashed to form mixed LNG stream 412.

The mixed LNG stream 412 is introduced into separation zone 420 via a second inlet 423, where the LNG product is separated from the flash gas. The LNG product collects in the sump zone 421 at the bottom of separation zone 420, where it is removed from the separation zone 420 via a third outlet 424 as LNG product stream 402. The separated flash gas stream that collects in the head space zone 422 passes through an optional mist eliminator 426 to remove entrained liquid droplets and is then warmed in the shell side 433 of the heat exchange zone 430 to produce a warmed flash gas stream 404, thereby providing cooling duty to heat exchange zone 430. The warmed flash gas stream 404 is removed from the heat exchange zone 430 via a third outlet 434 located at the top of the heat exchange zone, and is optionally compressed and cooled to produce a compressed flash gas stream that is recycled back into the natural gas feed stream or used for fuel gas (not shown). By cooling and liquefying an auxiliary natural gas feed stream 405A in the tube side 432 of heat exchange zone 430 via indirect heat exchange with the separated flash gas, refrigeration can be recovered from the separated flash gas.

In an alternative embodiment, similarly to FIG. 2 of the prior art, instead of cooling and liquefying an auxiliary natural gas feed stream 405A to warm flash gas stream 403, the heat exchange zone 430 can instead be used to cool a stream of refrigerant 405B to produce a cooled and/or liquefied refrigerant 406. The stream of refrigerant 405B (for example a portion 205 of the MRV stream as described in relation to FIG. 2) is introduced via first inlet 435 into the tube side 432 of the heat exchange zone 430 where it is cooled to provide a cooled refrigerant stream 406B that is withdrawn via first outlet 426 (and that can, for example, then be further used as described in relation to FIG. 2).

Figure 5:
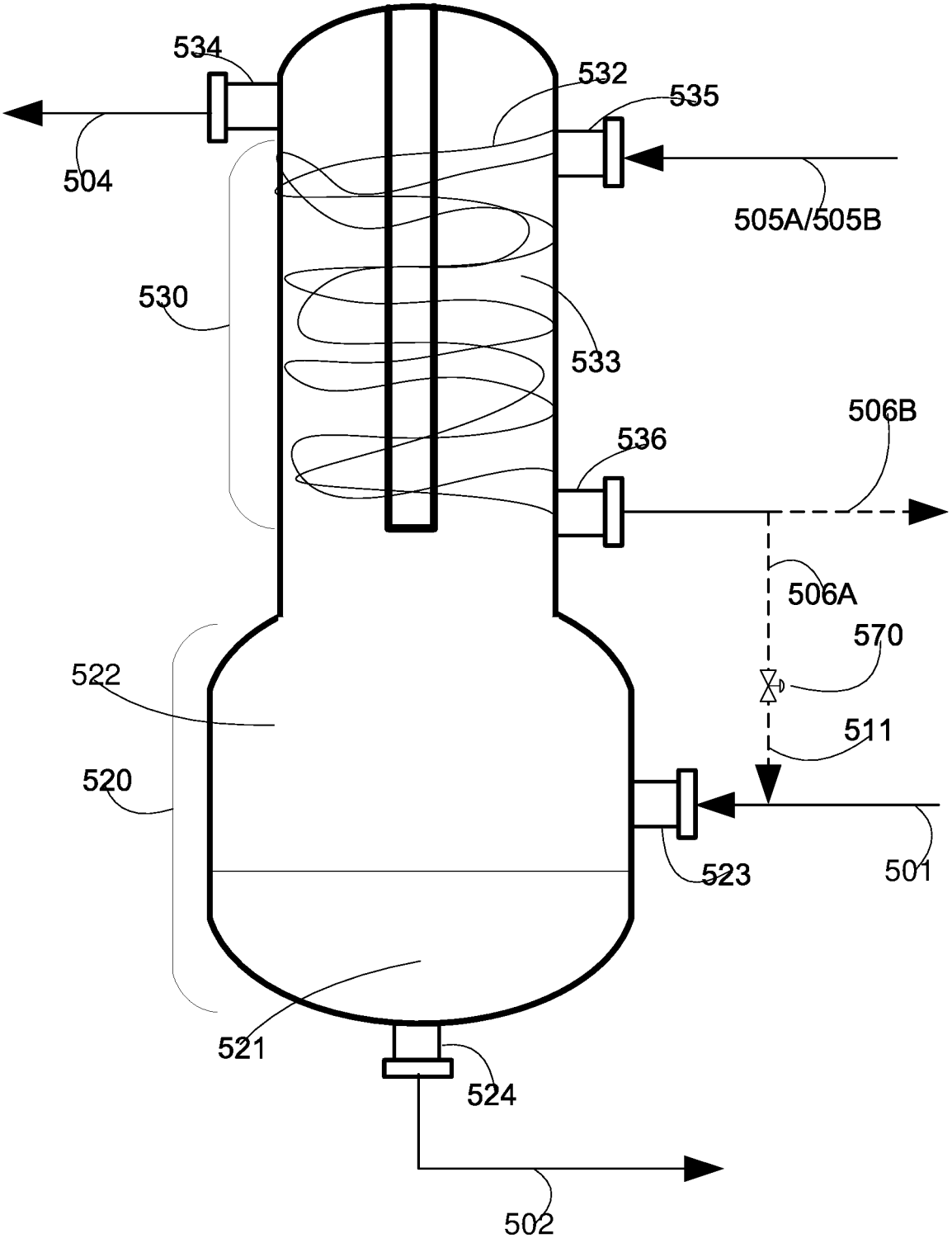
FIG. 5 is a schematic flow diagram depicting an apparatus for separating a flash gas from a liquefied natural gas (LNG) stream in accordance with a second embodiment.

FIG. 5 shows a further embodiment of an apparatus according to the present invention and a variation of FIG. 4. In this embodiment, the section of the shell casing enclosing the separation zone 520 has a wider diameter than the section of the shell casing enclosing the heat exchange zone 530. This arrangement may be preferred if the optimal diameter of the heat exchange zone is significantly smaller than the minimum diameter of the separation zone required for efficient vapor-liquid separation in the separation zone.

Figure 6:
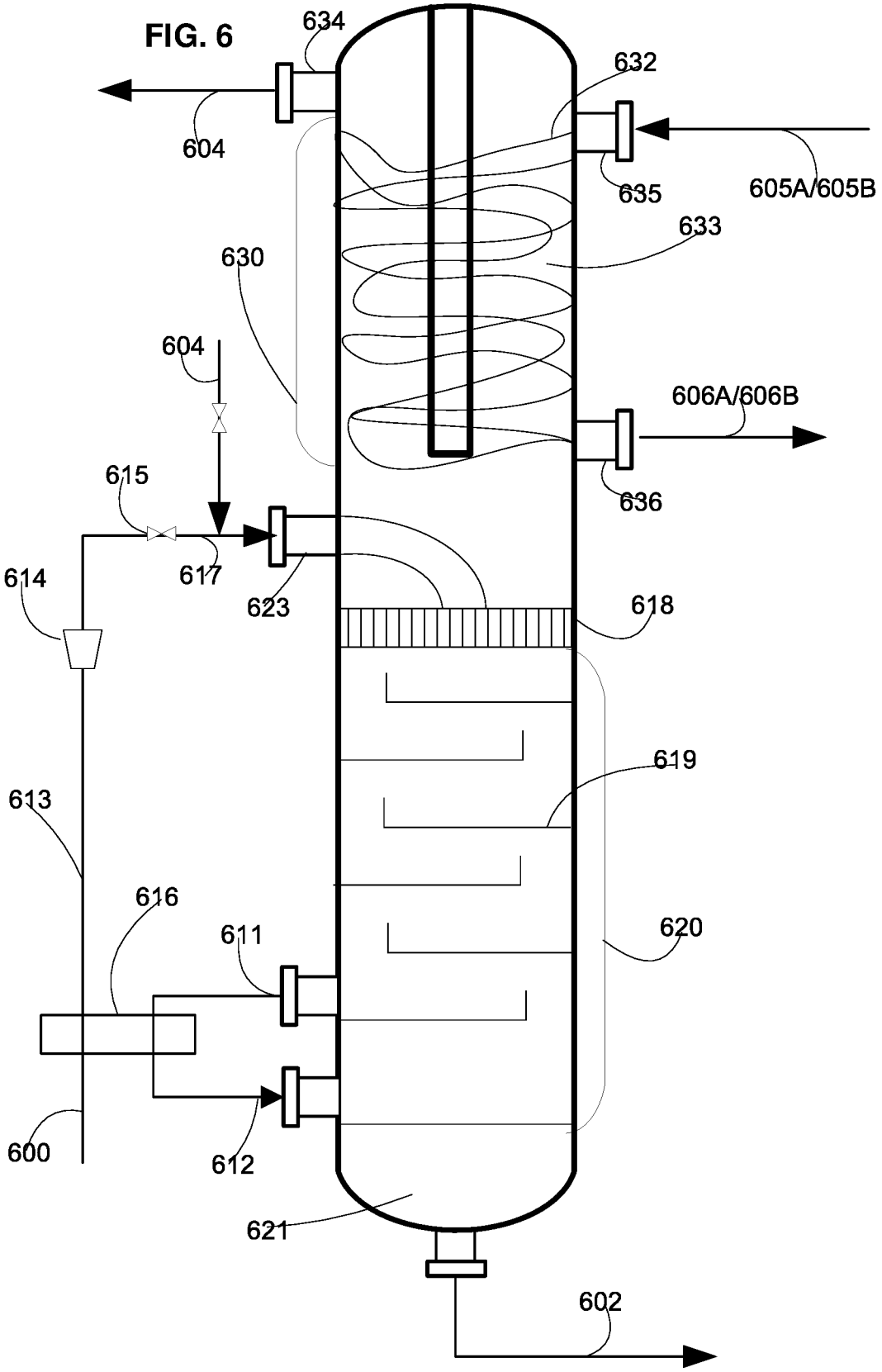
FIG. 6 is a schematic flow diagram depicting an apparatus for separating a flash gas from a liquefied natural gas (LNG) stream in accordance with a third embodiment.

FIG. 6 shows an embodiment of an apparatus according to the present invention applied to the prior art arrangement of FIG. 9. In this embodiment, the separation zone 620 includes one or more mass transfer devices, such as for example a plurality of plates or distillation trays 619 (as depicted). LNG stream 600 (such as for example LNG stream 900 of FIG. 9) is cooled in reboiler 616 to produce a cooled LNG stream 613. Cooled LNG stream 613 is expanded in an optional turbo-expander 614, and further reduced in pressure by passing the stream though pressure reduction device 615 to produce a reduced pressure LNG stream 617. Reduced pressure LNG stream 617 is introduced into the separation zone 620 via a first inlet 623, located at the top of the separation zone 620 above the one or more mass transfer devices, and passed through an optional distributor 618. The LNG flowing downward through the separation zone 620 is brought into contact with the rising vapor generated by reboiler 615. The separated flash gas stream passes through an optional mist eliminator to remove entrained liquid droplets (not shown), and is then warmed in the shell side 633 of the heat exchange zone 630 against a fluid stream such as an auxiliary natural gas stream 605A, similar to FIG. 9 or, alternatively, a refrigerant stream 605B, similar to FIG. 2, to produce a warmed flash gas stream 604, thereby providing cooling duty to heat exchange zone 630. The warmed flash gas 604 is withdrawn from the heat exchange zone 630 via a third outlet 634 located at the top of the heat exchange zone 630, and can be used for any suitable purpose, such as for example, being compressed and used for fuel gas (not shown).

Figure 7:
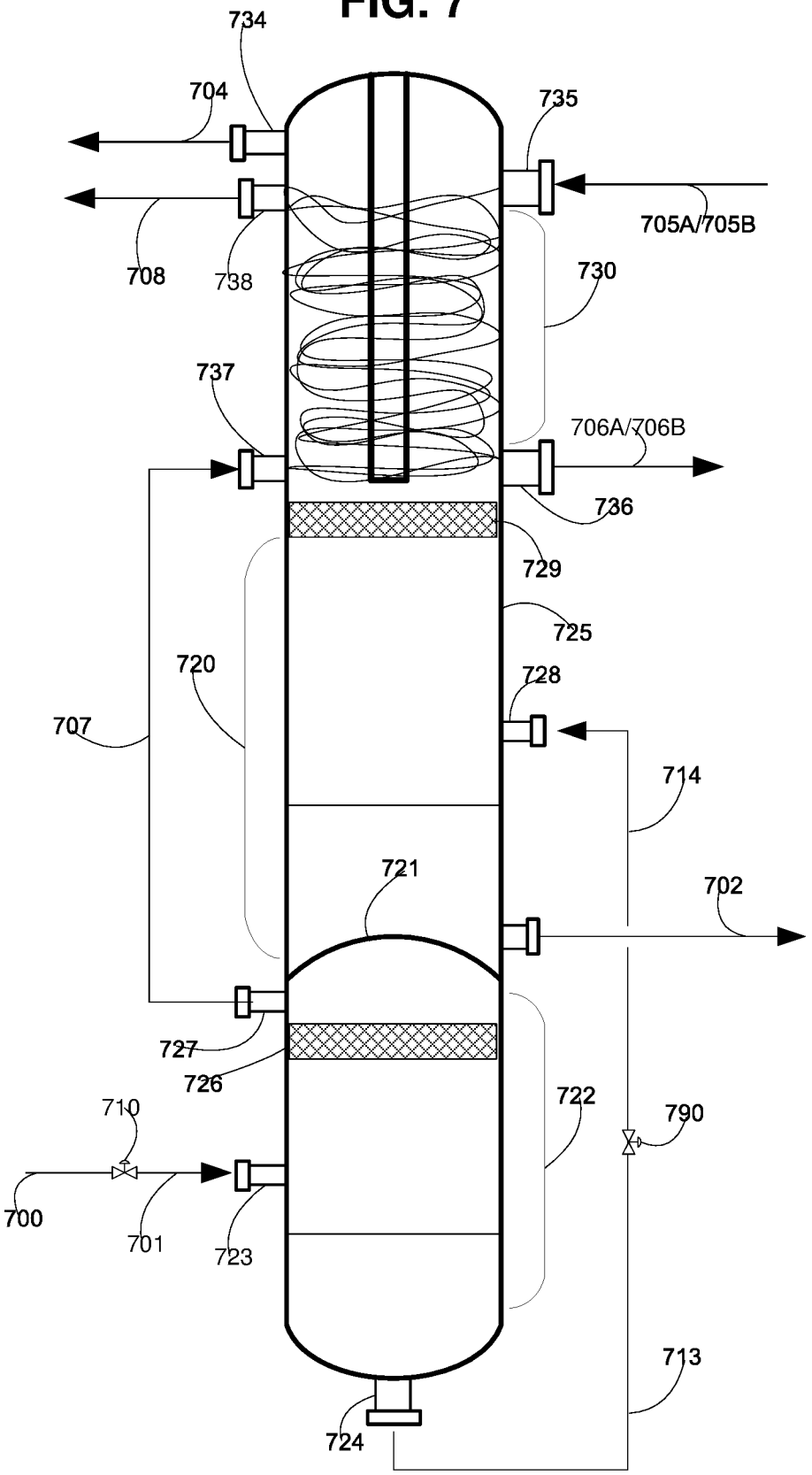
FIG. 7 is a schematic flow diagram depicting an apparatus for separating a flash gas from a liquefied natural gas (LNG) stream in accordance with a fourth embodiment.

FIG. 7 shows an embodiment of an apparatus according to the present invention that can, for example, be used in the prior art arrangement of FIG. 3 in place of flash gas heat exchanger 330, vapor-liquid separator 322, low pressure vapor-liquid separator 320, and associated piping. The apparatus comprises a shell casing 725 enclosing a heat exchange zone 730, a high pressure separation zone 722, and a low pressure separation zone 720, the two separation zones being separated by a dish pressure vessel head 721. Heat exchange zone 730 comprises a first coil wound tube bundle 731A and a second coil wound tube bundle 731B.

LNG stream 700 (such as for example LNG stream 300 of FIG. 3) is reduced in pressure by passing the stream through a first pressure reduction device 710 to produce a flashed main LNG stream 701.

In one embodiment of FIG. 7, an auxiliary natural gas feed stream 705A (such as for example stream 305 of FIG. 3) is introduced into heat exchange zone 730 via a first inlet 735 at the top of the heat exchange zone 730, where it is cooled and liquefied in the tube side of the first tube bundle 731A to produce an auxiliary LNG stream 706A, which is removed from the heat exchange zone 730 via a first outlet 736, located at the bottom of the heat exchange zone 730. The auxiliary LNG stream 706A can be reduced in pressure to produce a flashed auxiliary LNG stream, which can be mixed with the flashed main LNG stream 701 (not shown). Alternatively, the auxiliary LNG stream 706A can be combined with the main LNG stream 700 (not shown).

Flashed main LNG stream 701 is introduced into high pressure separation zone 722 via a second inlet 723, where is separated into LNG and a cold flash gas stream that is concentrated in helium (performing the same function as high pressure vapor-liquid separator 322 of FIG. 3). The cold flash gas passes through an optional mist eliminator 726, and is withdrawn as cold flash gas stream 707 via outlet 727. The LNG stream 713 via outlet 724, reduced in pressure to an intermediate pressure by passing through a second pressure reduction device 790 to produce a flashed LNG stream 714. The flashed LNG stream 714 is introduced into low pressure separation zone 720 via inlet 728, where it is separated into an LNG product stream 702 and separated flash gas 703.

The separated flash gas 703 rises through the low pressure separation zone 720, passes through an optional mist eliminator 729 and into the shell side 733 of the heat exchange zone 730 where it is warmed to produce a warmed flash gas stream 704, thereby providing cooling duty to the heat exchange zone 730. The warmed flash gas stream 704 is removed from the heat exchange zone 730 via a third outlet 734 located at the top of the heat exchange zone. Flash gas stream 707 is warmed in the tube side of the second tube bundle 731B to produce a second warmed flash gas stream 708. The second warmed flash gas stream 708 is removed from the heat exchange zone 730 via outlet 738. By cooling and liquefying an auxiliary natural gas feed stream 705A in the tube side 732 of the heat exchange zone 730, via indirect heat exchange with the separated flash gas, refrigeration can be recovered from the separated flash gas.

In an alternative embodiment of FIG. 7, similarly to FIG. 2 of the prior art, instead of cooling and liquefying an auxiliary natural gas feed stream 705A to warm flash gas stream 703, the heat exchange zone 730 can instead be used to cool a stream of refrigerant 705B to produce a cooled and/or liquefied refrigerant 706A. The stream of refrigerant 705B (for example a portion 205 of the MRV stream as described in relation to FIG. 2) is introduced into heat exchange zone 730 via a first inlet 735 at the top of the heat exchange zone 730, where it is cooled and liquefied in the tube side of the first tube bundle 731A to provide a cooled refrigerant stream 706B that is withdrawn via first outlet 736 (and that can, for example, then be further used as described in relation to FIG. 2).

Figure 8:
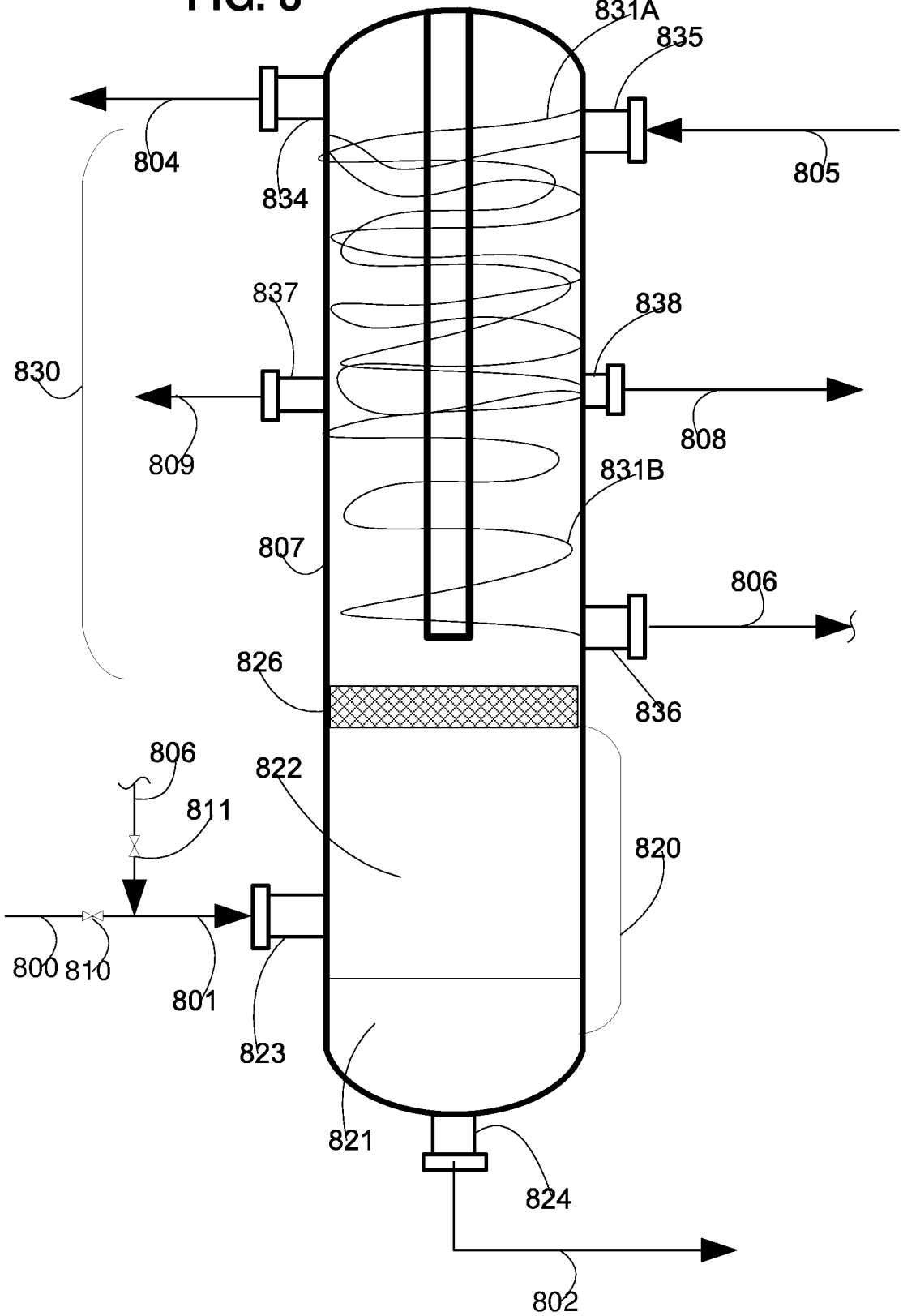
FIG. 8 is a schematic flow diagram depicting an apparatus for separating a flash gas from a liquefied natural gas (LNG) stream in accordance with a fifth embodiment.

FIG. 8 shows a further embodiment of the apparatus of the present invention applied to the prior art arrangement of FIG. 10. According to the invention, the apparatus of FIG. 8 may replace vapor-liquid separators 1014 and 1012 of FIG. 10, or alternatively may replace flash gas heat exchangers 1006 and 1004 of FIG. 10. In FIG. 8, the heat exchange zone 830 comprises a first (top) coil wound tube bundle 831A located above a second (bottom) coil wound tube bundle 831B.

LNG stream 800 (such as for example LNG stream 1000 of FIG. 10) is reduced in pressure by passing through a first pressure reduction device 810 (e.g. a J-T valve) to produce a flashed main LNG stream 801 which is introduced into separation zone 820 via a second inlet 823 where the LNG product is separated from the flash gas. The LNG product collects in the sump zone 821 at the bottom of separation zone 820, where it is removed from the separation zone 820 via a third outlet 824 as LNG product stream 802. The separated flash gas stream that collects in the head space zone 822 passes through an optional mist eliminator 826 and is then warmed in the shell side of the heat exchange zone 830 defined by the bottom (cold) coil wound tube bundle 831B, followed by warming in the shell side of the heat exchange zone 830 defined by the top coil wound tube bundle 831A to produce a warmed flash gas stream 804, thereby providing cooling duty to the heat exchange zone 830. The warmed flash gas stream 804 is withdrawn at near ambient temperature via outlet 834 located at the top of the heat exchange zone 830. Warmed flash gas stream 804 can then be fed to a compressor which compresses it to the pressure needed for plant fuel or the pressure of the incoming feed.

By cooling and/or liquefying an auxiliary natural gas feed stream 805 in the tube side of heat exchange zone 830 defined by the first and second coil wound tube bundles 831A and 831B, via indirect heat exchange with the separated flash gas, refrigeration can be recovered from the separated flash gas.

A cooled and/or liquefied portion 808 of the auxiliary natural gas feed stream 805 can be optionally withdrawn from the first coil wound tube bundle 831A via a fourth outlet 838, and the remaining portion of the auxiliary natural gas feed stream 805 can be further cooled and/or liquefied in the tube side of the second coil wound tube bundle 831B, before exiting as auxiliary LNG stream 806 via outlet 836 located at the bottom of the heat exchange zone 830. The benefits of removing the portion 808 from the fourth outlet are the same as the benefits by removing streams 1030 and 1032 in FIG. 10.

FIG. 8 also shows an alternative configuration not shown in prior art FIG. 10 in which a partially warmed flash gas stream 809 is removed from the shell side of the heat exchange zone 830 via a fourth outlet 837, rather than removing a portion of the partially cooled and/or liquefied auxiliary natural gas feed stream from the tube side of the heat exchange zone 830. This provides similar benefits to removing portion 808 from auxiliary natural gas feed stream 805.

Example 1

This example is based on the application of an apparatus according the present invention as described and depicted in FIG. 4, and used in the prior art arrangement of FIG. 2 for an LNG plant producing 1 MTPA. The reference numerals of FIG. 4 are used and the results are shown in Tables 1-3.

A stream of refrigerant 405B (for example a portion 205 of the MRV stream as described in relation to FIG. 2) is introduced into the heat exchange zone 430 via a first inlet 435. The stream of refrigerant 405B has a temperature close to ambient, and a pressure of about 900 PSIA. The flowrate is about 1100 lbmoles/hr and represents about 4% of the MRV stream. The stream of refrigerant 405B is cooled and liquefied in the tube side 432 of the heat exchange zone 430. The cooled refrigerant stream 406B stream is withdrawn from the heat exchange zone 430 via a first outlet 436 at a temperature of about −245° F. The cooled refrigerant stream 406B is then reduced in pressure to a pressure of about 75 PSIA, to produce a cooled refrigerant stream that is introduced the cold side of the MCHE.

The main LNG stream 400 has a flowrate of about 19,000 lbmole/hr and exits the MCHE at a temperature of about −232° F. before passing the stream through a first pressure reduction device 410 to produce a flashed main LNG stream 401 having a pressure of about 16.5 PSIA. The reduction in pressure results in a two phase stream having a molar vapor fraction of about 14%. The flashed main LNG stream 401 is introduced into the separation zone 420 via a second inlet 423 where it is separated into LNG product and flash gas. The LNG product collects in the sump zone 421, and is withdrawn from the separation zone 420 via a third outlet 424. The separated flash gas stream that collects in the head space zone 422 passes through a mist eliminator 426 to remove entrained liquid droplets and the separated flash gas is then warmed in the shell side 433 of the heat exchange zone 430 to produce a warmed flash gas stream 404, thereby providing cooling duty to the heat exchange zone 430. The warmed flash gas stream 404 is withdrawn from the heat exchange zone 430 via a third outlet 434 at a pressure of about 15 PSIA, before being compressed to a pressure of about 900 PSIA, and being recycled and combined with the natural gas feed stream.

For this example, the shell casing 425 has an overall diameter of about 5.6 feet and a height of about 70 feet. The height of the separation zone 420 is about 30 feet.

Tables 1 and 2 show representative sizing of the shell casing diameter as a function of LNG production. The tables are based on the main LNG stream 400 exiting the MCHE at a temperature of −232° F. and a pressure of about 810 PSIA. After reducing the pressures of the LNG stream to about 18 PSIA (the pressure at the bottom of the separation zone 420) the mixed LNG stream 412 entering the separation zone 420 is 12% vapor (molar).

TABLE 1

| Capacity, MTPA | Optimal bundle diameter, ft | Minimum separator diameter, ft | Combined device diameter, ft |
|---|---|---|---|
| 1 | 5.61 | 6.24 | 6.24 |
| 2 | 7.57 | 8.41 | 8.41 |
| 3 | 8.93 | 9.92 | 9.92 |
| 4 | 10.30 | 11.44 | 11.44 |
| 5 | 11.34 | 12.60 | 12.60 |
| 6 | 12.46 | 13.84 | 13.84 |
| 7 | 13.51 | 15.01 | 15.01 |
| 8 | 14.32 | 15.91 | 15.91 |

TABLE 2

| Capacity, MTPA | Optimal bundle diameter, ft | Minimum separator diameter, ft | Combined device diameter, ft |
|---|---|---|---|
| 1 | 5.61 | 4.93 | 5.61 |
| 2 | 7.57 | 6.65 | 7.57 |
| 3 | 8.93 | 7.84 | 8.93 |
| 4 | 10.30 | 9.04 | 10.30 |
| 5 | 11.34 | 9.96 | 11.34 |
| 6 | 12.46 | 10.94 | 12.46 |
| 7 | 13.51 | 11.87 | 13.51 |
| 8 | 14.32 | 12.58 | 14.32 |

Sizing of the diameter of the shell casing depends on two factors. In particular, the need for effective separation and disengagement of liquid droplets in the separation zone 420 sets a minimum diameter for the shell casing enclosing the separation zone 420 (referred to in Tables 1 and 2 as the "minimum separator diameter"), whilst there is also an optimal diameter for the shell casing enclosing the heat exchange zone 430 (referred to in Tables 1 as 2 as the "optimal bundle diameter")

Table 1 is based on vapor-liquid separation without a mist eliminator. For this example, the optimal diameter for the shell casing enclosing the heat exchange zone 430 is 11% smaller than the minimum diameter required for effective separation in the separation zone 420. Therefore, if no mist eliminator device is present, it is preferred to adopt a shell casing having an overall diameter (referred to in Tables 1 and 2 as the "combined device diameter) that is larger than the optimal diameter for the shell casing enclosing the heat exchange zone. Alternatively, it may be necessary to adopt a shell casing having a variable diameter for the two zones, i.e. a larger diameter for the separation zone 420 than for the heat exchange zone 430 (as shown in FIG. 5).

Table 2 is based on vapor-liquid separation using a mist eliminator to capture entrained droplets in the rising vapor, thus allowing the separation zone to be designed with a smaller minimum diameter. In this example, the use of a mist eliminator reduces the required minimum diameter of the shell casing enclosing the separation zone 420 to below the optimal diameter of the shell casing enclosing the heat exchanger zone 430, allowing the vessel to be built at the optimal diameter of the heat exchanger zone 430. The diameters shown were generated using standard heat exchanger and separation vessel design procedures known to people skilled in the art.

The data in Table 3 shows the advantages of the current invention with respect to plot area, equipment count, and pressure drop when compared to the prior art arrangement of FIG. 1. The reduction in pressure drop is a substantial benefit because of the low operating pressure of the flash drum. The power required to recompress the flash is reduced by about 2% with a 1 psi reduction in pressure drop.

TABLE 3

| | Prior Art | Invention |
|---|---|---|
| Number of pieces of equipment | 2 | 1 |
| Footprint | 10 ft × 10 ft for the drum 120 10 ft × 10 ft for the flash exchanger cold box 130 | 10 ft × 10 ft for the integrated service |
| Interconnecting piping line 103 | 300 ft with 6 elbows used to connect the flash drum overhead and cold box, insulated | Eliminated |

TABLE 3-continued

| | Prior Art | Invention |
|---|---|---|
| Pressure drop from flash drum (vapor-liquid separator) 120 to Flash gas heat exchanger 130 | 1-1.5 psi | 0 psi |

Example 2

This example is based on the application of the apparatus according to the present invention described and depicted in FIG. 8, as applied to the prior art arrangement of FIG. 10 for an LNG plant producing 3 MTPA. The reference numerals of FIG. 8 are used.

LNG stream 800 exits the MCHE (equivalent to 1000 of FIG. 10) at a temperature of −159° F. and is reduced in pressure to a pressure of 153 PSIA to produce a flashed main LNG stream 801. The flashed main LNG stream 801 is introduced into the separation zone 820 along with an auxiliary LNG stream 806 resulting in a flash vapor stream having a flow rate of 18,000 lbmole/h, which is 23% of the combined feed entering the separation zone 820.

The LNG product and the flash gas are separated in the separation zone 820. The LNG product collects in the sump zone 821, and is withdrawn from the separation zone 820 via a third outlet 824. The separated flash gas is warmed to near ambient temperature (78° F.) by passing the separated flash gas sequentially through the shell side of the heat exchange zone 830 defined by the bottom coil wound tube bundle 831B (cold section tube bundle) and then the shell side of the heat exchange zone defined by the top coil wound tube bundle 831A (warm section tube bundle). The bottom coil wound tube bundle 831B has a diameter of 7.7 feet and length of 40 feet and the top coil wound tube bundle 831A has a diameter of 7.7 feet and a length of 32 feet long.

The separated flash gas is warmed by cooling and liquefying an auxiliary natural gas feed stream 805, which is about 20% of the total feed to the plant. The auxiliary natural gas feed stream 805 has a flowrate of 12,000 lbmole/hr, a pressure of about 1350 PSIA and a temperature of about 85° F. The auxiliary natural gas feed stream 805 is cooled to a temperature of 0° F. in the top coil wound tube bundle 831A, and a cooled and/or liquefied portion 808 of the auxiliary natural gas feed stream 805 having a flowrate of 3600 lbmole/hr is withdrawn via outlet 838 and is sent to the MCHE (not shown). The remaining portion of the auxiliary natural gas feed stream 805 is further cooled and/or liquefied in the bottom coil wound tube bundle 831B, and is withdrawn via outlet 836 as auxiliary LNG stream 806 at a temperature of −196° F. The auxiliary LNG stream 806 is reduced in pressure to 153 PSIA to provide a flashed auxiliary LNG stream 811, which is then combined with the flashed first main LNG stream 801 and introduced into the separation zone 820 where is it separated into LNG product and flash gas.

Alternatively, 20% of the warmed separated flash gas stream is removed through outlet 837 as stream 809. This will also improve the cooling curves in the flash exchanger.

For this example, the separation zone includes a mist eliminator. The shell casing has a diameter of about 8 feet and a height of about 165 feet.

It will be appreciated that the invention is not restricted to the details described above with reference to the preferred embodiments but that numerous modifications and variations can be made without departing from the spirit or scope of the invention as defined in the following claims.

The invention claimed is:

1. A system for producing a liquefied natural gas (LNG) product, and for recovering refrigeration from the flash gas, the system comprising:

a main cryogenic heat exchanger (MCHE) for cooling and liquefying a natural gas feed stream so as to produce an LNG stream;

a refrigeration circuit in fluid flow communication with the MCHE for circulating a main refrigerant and passing one or more cold streams of the refrigerant through the MCHE so as to provide cooling duty for liquefying the natural gas stream, the one or more cold streams of refrigerant being warmed in the MCHE via indirect heat exchange with the natural gas stream;

a first pressure reduction device in fluid flow communication with the MCHE for reducing the pressure of all or a portion of the LNG stream to form a reduced pressure LNG stream;

an apparatus, in fluid flow communication with the first pressure reduction device, for separating flash gas from the reduced pressure LNG stream and recovering refrigeration from the separated flash gas to produce an LNG product stream and a warmed flash gas stream, the apparatus comprising a shell casing enclosing a heat exchange zone and a separation zone, the heat exchange zone being located above and in fluid communication with the separation zone, the separation zone configured to separate the flash gas from the LNG product and the heat exchange zone being configured to recover refrigeration from the separated flash gas;

wherein the heat exchange zone comprises at least one coil wound tube bundle defining a tube side and a shell side of the heat exchange zone, the tube side defining one or more passages through the heat exchange zone for cooling and/or liquefying a first fluid stream, and the shell side defining a passage through the heat exchange zone for warming separated flash gas;

wherein the separation zone is configured such that flash gas separated from the LNG product in the separation zone flows upwards from the separation zone into and through the shell side of the heat exchange zone;

and wherein the shell casing has:

a first inlet in fluid flow communication with the tube side of the heat exchange zone for introducing the first fluid stream to be cooled and/or liquefied;

a first outlet in fluid flow communication with the tube side of the heat exchange zone for withdrawing a first cooled and/or liquefied fluid stream;

a second outlet in fluid flow communication with the shell side of the heat exchange zone for withdrawing the warmed flash gas stream;

a second inlet in fluid flow communication with the separation zone for introducing the reduced pressure LNG stream containing flash gas to be separated; and a third outlet in fluid flow communication with the separation zone for withdrawing the LNG product stream.

2. A system according to claim 1, wherein the first fluid stream is an auxiliary natural gas feed stream to be cooled and liquefied in the heat exchange zone to produce an auxiliary LNG stream, the system is configured to reduce the pressure of the auxiliary LNG stream, and the apparatus for separating flash gas from the reduced pressure LNG stream and recovering refrigeration from the separated flash gas is configured to also receive the reduced pressure auxiliary LNG stream, separate flash gas from the reduced pressure auxiliary LNG stream, and recover refrigeration from the separated flash gas.

3. A system according to claim 1, wherein the refrigeration circuit is in fluid flow communication with the apparatus for separating flash gas from the reduced pressure LNG stream and recovering refrigeration from the separated flash gas the first fluid stream is a stream of gaseous refrigerant to be cooled and/or liquefied in the heat exchange zone to provide a stream of cooled and/or liquefied refrigerant, and the refrigeration circuit is configured to introduce the stream of gaseous refrigerant into the first inlet of the apparatus, to withdraw the stream of cooled and/or liquefied refrigerant from the first outlet of the apparatus, and to pass the stream of cooled and/or liquefied refrigerant through the MCHE.

4. A system according to claim 1, wherein the apparatus for separating flash gas from the reduced pressure LNG stream and recovering refrigeration from the separated flash gas further comprising a mist eliminator positioned between the heat exchange zone and the separation zone.

5. A system according to claim 1, wherein a first section of the shell casing enclosing the heat exchange zone and a second section of the shell casing enclosing the separation zone have substantially the same diameter.

6. A system according to claim 1, wherein a second section of the shell casing enclosing the separation zone has a larger diameter than a first section of the shell casing enclosing the heat exchange zone.

7. A system according to claim 1, wherein the separation zone comprises one or more mass transfer devices for bringing downward flowing fluid into contact with upward rising vapor and wherein the second inlet is positioned above one or more of the mass transfer devices.

8. A system according claim 1, wherein the apparatus for separating flash gas from the reduced pressure LNG stream and recovering refrigeration from the separated flash gas further comprises a reboiler heat exchanger for re-boiling a portion of the LNG from a bottom end of the separation zone so as to generate upward flowing vapor through the separation zone.

9. A system according to claim 1, wherein the separation zone is an empty section of the shell casing defining a sump zone for collection of LNG and a head space zone above the sump zone and below the heat exchange zone for collection of flash gas.

10. A system according claim 1, wherein the at least one coil wound tube bundle comprises a first coil wound tube bundle located above a second coil wound tube bundle for warming separated flash gas;

wherein the tube side defined by the first tube bundle is in fluid flow communication with the first inlet and defines at least one passage for cooling and/or liquefying the first fluid stream;

wherein the shell casing has a fourth outlet in fluid flow communication with the tube side of the first tube bundle for withdrawing a cooled and/or liquefied portion of the first fluid stream from the first tube bundle; and wherein the tube side defined by the second tube bundle is in fluid flow communication with the tube side of the first tube bundle and with the first outlet, and defines at least one passage for further cooling and/or liquefying another portion of the first fluid stream from the first tube bundle.

11. A system according to claim 1, the wherein the shell casing has a fourth outlet in fluid flow communication with the shell side of the heat exchange zone, and located below the second outlet, for withdrawing a partially warmed flash gas stream at a lower temperature than the warmed flash gas stream withdrawn from the second outlet.

* * * * *